US011660720B2

(12) United States Patent
Cai et al.

(10) Patent No.: US 11,660,720 B2
(45) Date of Patent: May 30, 2023

(54) WHEEL RIM FINISHING DEVICE

(71) Applicant: CITIC Dicastal Co., Ltd., Qinhuangdao (CN)

(72) Inventors: Weimin Cai, Qinhuangdao (CN); Jiandong Guo, Qinhuangdao (CN); Xiaoguang Huang, Qinhuangdao (CN); Yajun Wang, Qinhuangdao (CN); Xiao Liu, Qinhuangdao (CN); Lijie Hu, Qinhuangdao (CN); Yao Zheng, Qinhuangdao (CN); Zhiyuan Yu, Qinhuangdao (CN)

(73) Assignee: CITIC Dicastal Co., Ltd., Qinhuangdao (CN)

( * ) Notice: Subject to any disclaimer, the term of this patent is extended or adjusted under 35 U.S.C. 154(b) by 865 days.

(21) Appl. No.: 16/669,446

(22) Filed: Oct. 30, 2019

(65) Prior Publication Data

US 2020/0338687 A1 Oct. 29, 2020

(30) Foreign Application Priority Data

Apr. 29, 2019 (CN) ..... 201910353261.4

(51) Int. Cl.
*B24B 29/04* (2006.01)
*B21D 53/30* (2006.01)

(52) U.S. Cl.
CPC ..... *B24B 29/04* (2013.01); *B21D 53/30* (2013.01)

(58) Field of Classification Search
CPC .. B24B 29/04; B24B 5/44; B24B 5/08; B24B 9/00; B24B 19/26; B24B 21/12; B24B 27/0023; B24B 27/0076; B24B 27/0069; B24B 27/003; B24B 27/0053; B24B 41/06; B24B 41/067; B21D 3/14; B21D 1/12; B21D 53/30; B23Q 17/005; B23Q 2220/004; B23Q 7/02; B23Q 7/055; B23Q 7/06; B23Q 3/002; B23Q 1/5468
See application file for complete search history.

(56) References Cited

U.S. PATENT DOCUMENTS

| | | | | |
|---|---|---|---|---|
| 4,074,408 A * | 2/1978 | Davis | B60B 3/04 | 72/401 |
| 4,848,125 A * | 7/1989 | Itou | B21D 53/30 | 72/455 |
| 5,634,361 A * | 6/1997 | Herschman | B21D 3/14 | 72/68 |
| 6,901,676 B1 * | 6/2005 | Macke | G01B 5/252 | 33/712 |
| 7,921,687 B2 * | 4/2011 | Stretch | B21D 1/08 | 72/705 |

* cited by examiner

*Primary Examiner* — Joel D Crandall
*Assistant Examiner* — Makena S Markman
(74) *Attorney, Agent, or Firm* — IPro, PLLC

(57) ABSTRACT

The present disclosure discloses a wheel rim finishing device. A motor is fixedly mounted on a stand through a shaft sleeve I. A supporting body is arranged on the stand. The side, close to a locating disk, of the supporting body is provided with an outer roller. An inner driving roller body and an inner driven roller body are arranged at a position, close to the outer roller, on the inner side of the locating disk. The wheel rim finishing device is simple in structure and high in universality, and may adapt to wheel types with different rim structures.

8 Claims, 3 Drawing Sheets

WHEEL RIM FINISHING DEVICE

FIELD

The present disclosure relates to the technical field of wheel rim finishing, and more particularly relates to a wheel rim finishing device.

BACKGROUND

A machined blank of an aluminum wheel is obtained by processes such as smelting, casting and thermal treatment. A rim part of an actual machined blank deforms, and it is particularly serious for the position close to an inner flange, causing that rims of machined blanks of part of wheel types are relatively low in roundness. Problems of eccentricity and failure in machining exist in a machining process, and affect the finished product ratio and the machining quality of the aluminum wheel. In order to solve the problem of failure in machining of blanks, a blank rim would be thickened in actual production, which leads to waste of an aluminum alloy raw material and increase of the cost.

SUMMARY

In view of this, the present disclosure aims to provide a wheel rim finishing device, which finishes a blank rim before machining to improve the roundness of the blank rim and then improve the finished product ratio and the machining quality of a wheel, and may further reduce the machining volume of a blank and lower the manufacturing cost of the wheel.

In order to achieve the above objective, the technical solution of the present disclosure is realized as follows.

A wheel rim finishing device includes a stand, a motor and a shaft sleeve I. The motor is fixedly mounted on the stand through the shaft sleeve I. A rotating component is fixed on the stand. A locating disk is arranged on the rotating component. A supporting body is also arranged on the stand, and may do reciprocating motion along a radial direction of the locating disk. The side, away from the locating disk, of the supporting body is provided with a force application screw, and the side, close to the locating disk, of the supporting body is provided with an outer roller. An inner driving roller body and an inner driven roller body are arranged at a position, close to the outer roller, on the inner side of the locating disk. The inner driving roller body is fixedly connected to the output end of the motor, and the inner driven roller body is fixedly connected to the stand.

In one embodiment, a weighing sensor is arranged between the supporting body and the force application screw. One end of the weighing sensor is in threaded connection with the force application screw, and the other end of the weighing sensor is fixedly connected with the supporting body.

In one embodiment, the rotating component includes a mounting seat fixed on the stand. A thrust ball bearing and a deep groove ball bearing are arranged on the mounting seat in sequence from inside to outside. The locating disk is mounted on the deep groove ball bearing.

In one embodiment, a supporting seat I and a supporting seat II are also fixed on the stand. The supporting body is mounted in a guide hole of the supporting seat II. The force application screw is in threaded connection with the supporting seat I and the weighing sensor.

In one embodiment, an outer roller mounting seat is arranged between the supporting body and the outer roller.

One end of the outer roller mounting seat is fixedly connected with the supporting body. The other end of the outer roller mounting seat is connected with the outer roller through a locating pin.

In one embodiment, the inner driving roller body is arranged in the shaft sleeve I, and is connected with the motor through a key.

In one embodiment, inner roller heads are arranged on the inner driving roller body and the inner driven roller body.

In one embodiment, the inner roller heads are of tooth-form structures.

In one embodiment, the outer surfaces of the inner roller heads and the outer roller follow the shape of the structure of a wheel rim.

Compared with the prior art, the wheel rim finishing device of the present disclosure has the following advantages.

A machined blank rim is finished to improve the roundness of the blank rim and then improve the finished product ratio and the machining quality of a wheel. The wheel rim finishing device has the characteristics of simple structure, easy operation, high universality and the like, and may adapt to wheel types with different rim structures.

BRIEF DESCRIPTION OF THE DRAWINGS

The drawings constituting one part of the present disclosure are used to provide a further understanding of the present disclosure. Illustrative embodiments and descriptions thereof of the present disclosure are used to explain the present disclosure, and do not constitute an improper limitation to the present disclosure. In the drawings.

DESCRIPTIONS OF NUMERALS IN THE DRAWINGS

1: stand; 2: motor; 3: shaft sleeve I; 4: supporting seat I; 5: weighing sensor; 6: supporting body; 7: supporting seat II; 8: outer roller mounting seat; 9: locating pin; 10: outer roller; 11: wheel blank; 12: inner roller head; 13: inner driving roller body; 14: inner driven roller body; 15: pressing plate; 16: shaft sleeve II; 17: locating disk; 18: mounting seat; 22: force application screw; 25: thrust ball bearing; 26: deep groove ball bearing; and 31: key.

DETAILED DESCRIPTION

It should be noted that the embodiments in the present disclosure and features in the embodiments may be combined with each other without conflicts.

Technical solutions of the present disclosure will be described clearly and completely below in combination with the drawings and the embodiments. Obviously, the embodiments described herein are only part of the embodiments of the present disclosure, not all the embodiments. Based on the embodiments in the present disclosure, all other embodiments obtained by those ordinarily skilled in the art without doing creative work shall fall within the protection scope of the present disclosure.

A wheel rim finishing device of an embodiment of the present disclosure is described below with reference to FIG. 1 to FIG. 3 and in combination with the embodiment.

Figure 1:
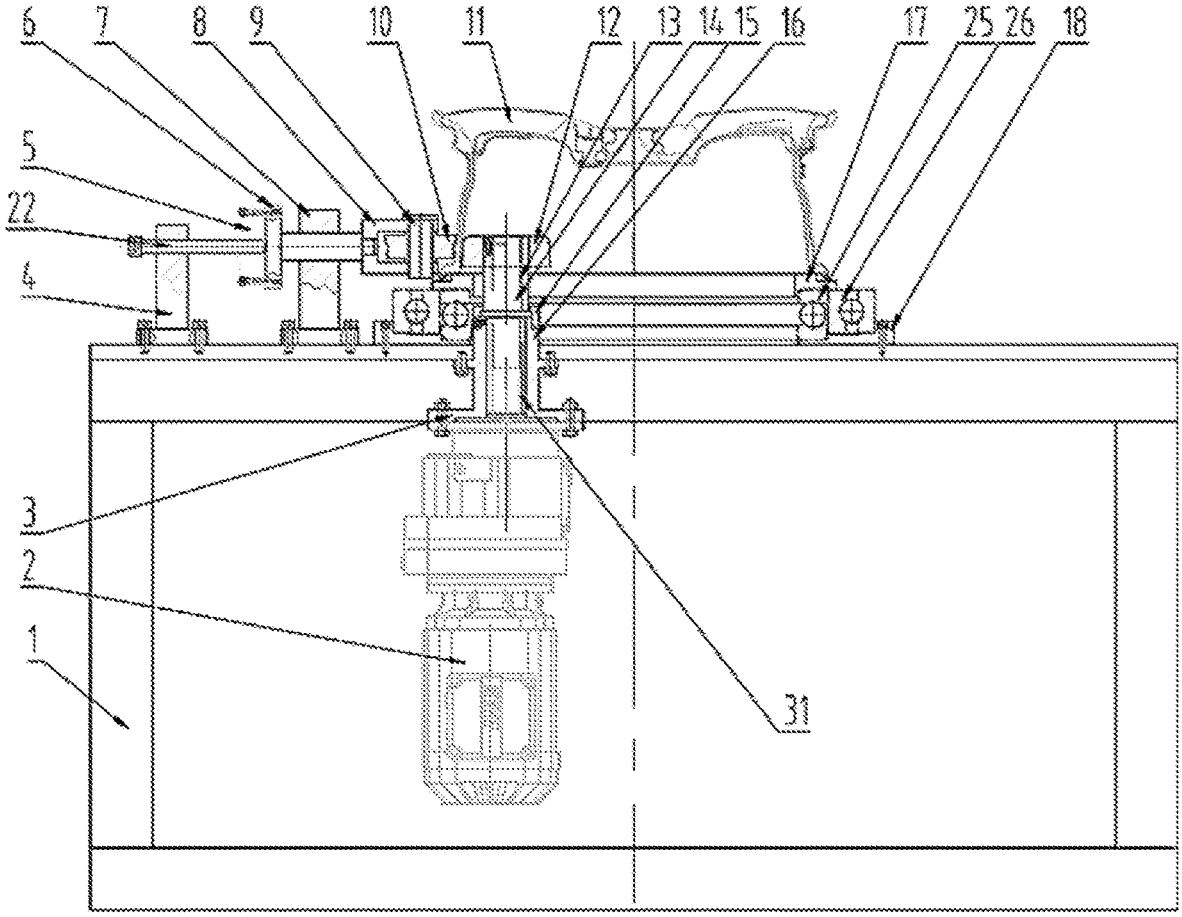
FIG. 1 is a front view of a wheel rim finishing device of the present disclosure.
Figure 2:
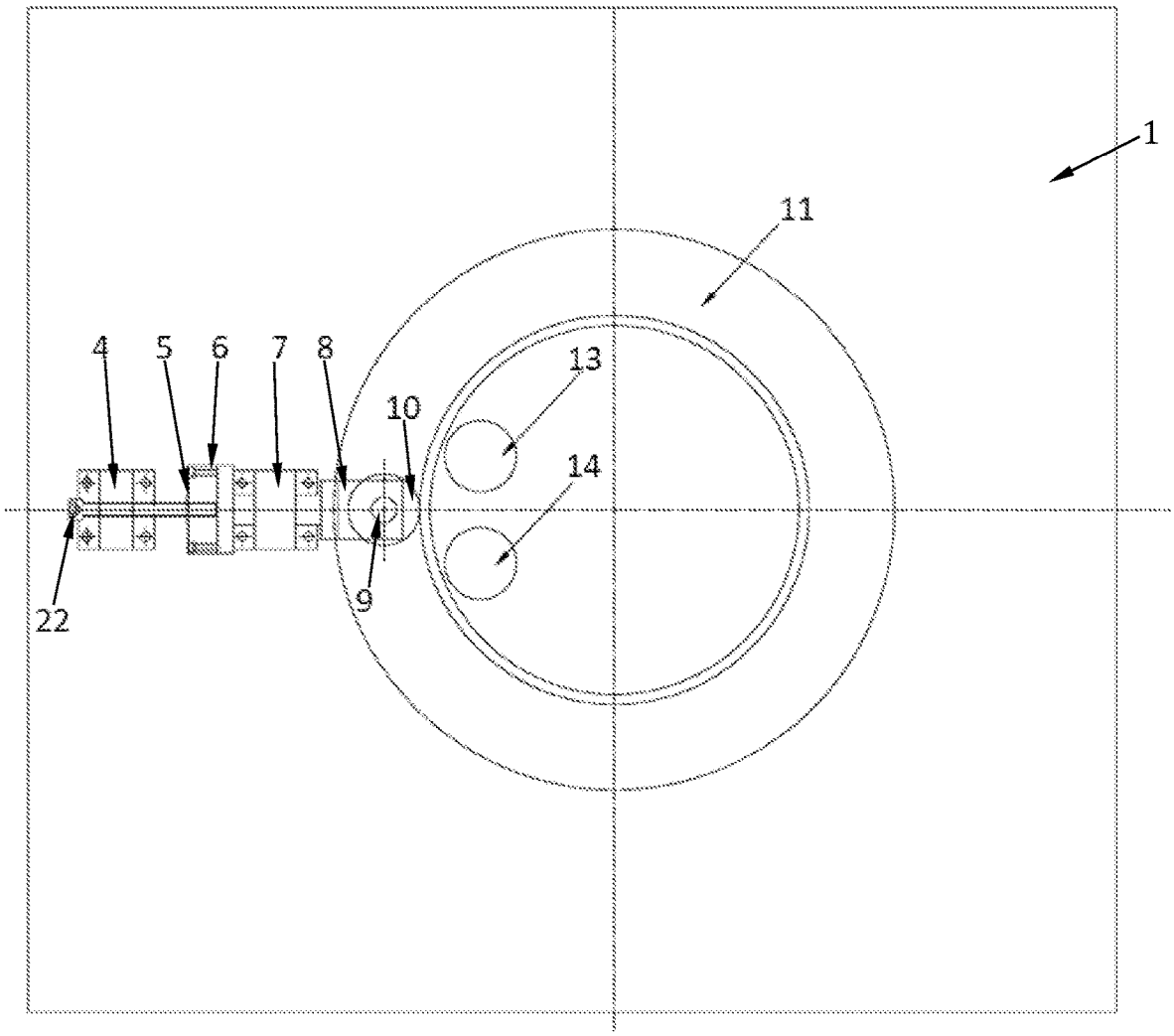
FIG. 2 is a top view of a wheel rim finishing device of the present disclosure.
Figure 3:
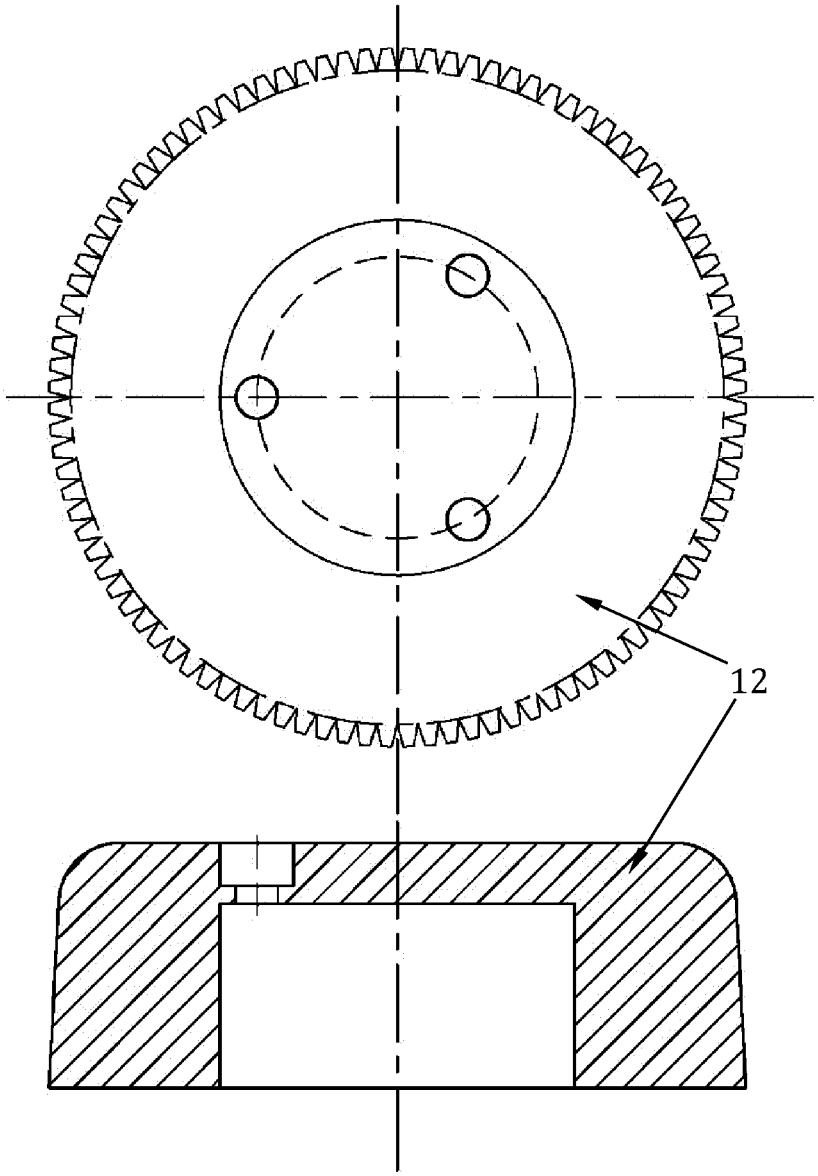
FIG. 3 is a structural diagram of an inner roller head of a wheel rim finishing device of the present disclosure.

The wheel rim finishing device as shown in FIG. 1 to FIG. 3 includes: a stand 1, a motor 2, a shaft sleeve I 3, a supporting seat I 4, a weighing sensor 5, a supporting body 6, a supporting seat II 7, an outer roller mounting seat 8, a locating pin 9, an outer roller 10, a wheel blank 11, inner roller heads 12, an inner driving roller body 13, an inner driven roller body 14, a pressing plate 15, a shaft sleeve II 16, a locating disk 17, a mounting seat 18, a force application screw 22, a thrust ball bearing 25, a deep groove ball bearing 26, a key 31 and other structures.

The mounting seat 18 is fixed on the stand 1 through a plurality of screws. The thrust ball bearing 25 and the deep groove ball bearing 26 are respectively mounted on the mounting seat 18. The locating disk 17 and the deep groove ball bearing 26 are mounted in a cooperating manner. The wheel blank 11 is placed on the locating disk 17. The supporting seat I 4 and the supporting seat II 7 are respectively fixed on the stand 1 through a plurality of screws. The supporting body 6 is mounted in a guide hole of the supporting seat II 7. The outer roller mounting seat 8 is mounted in the supporting body 6. The outer roller 10 is connected to the outer roller mounting seat 8 through the locating pin 9. The weighing sensor 5 is mounted on the supporting body 6 through screws. The force application screw 22 is in threaded connection with the supporting seat I 4 and the weighing sensor 5. The shaft sleeve I 3 and the shaft sleeve II 16 are respectively fixed on the stand 1 through a plurality of screws. The motor 2 is connected to the shaft sleeve I 3 through nuts and screws. The inner driving roller body 13 is mounted in the shaft sleeve I 3, and is connected with the motor 2 through the key 31. The inner driven roller body 14 is mounted in the shaft sleeve II 16. The pressing plate 15 is mounted on the shaft sleeve I 3 and the shaft sleeve II 16 through screws. The inner roller heads 12 are respectively mounted on the inner driving roller body 13 and the inner driven roller body 14 through screws.

In the present embodiment, the inner roller heads 12 have a diameter of 115 mm, and a distance between the inner roller heads 12 is 155 mm. The outer roller 10 has a diameter of 90 mm. The motor has a speed of 15 r/min. The heating temperature of a heating furnace is 350 DEG C. The heat preservation duration is 10 min, and the finishing force is 35 KN.

Compared with the prior art, the wheel rim finishing device of the present disclosure has the following advantages.

A machined blank rim is finished to improve the roundness of the blank rim and then improve the finished product ratio and the machining quality of a wheel. The wheel rim finishing device has the characteristics of simple structure, easy operation, high universality and the like, and may adapt to wheel types with different rim structures.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

The invention claimed is:

1. A wheel rim finishing device, comprising:

a stand;

a shaft sleeve;

a motor fixedly mounted on the stand through the shaft sleeve;

a rotating component fixed on the stand;

a locating disk arranged on the rotating component;

a supporting body arranged on the stand and configured to movably reciprocate in a radial direction of the locating disk;

a force application screw provided on first side, of the supporting body distal from the locating disk;

an outer roller provided on a second side, of the supporting body proximate the locating disk;

an inner driving roller body and an inner driven roller body arranged, on the inner side of the locating disk and at a position close to the outer roller, the inner driving roller body is fixedly connected to the output end of the motor, and the inner driven roller body is fixedly connected to the stand; and a weighing sensor arranged between the supporting body and the force application screw, one end of the weighing sensor is in threaded connection with the force application screw, and the other end of the weighing sensor is fixedly connected with the supporting body.

2. The wheel rim finishing device according to claim 1, wherein the rotating component comprises a mounting seat fixed on the stand; a thrust ball bearing and a deep groove ball bearing are arranged on the mounting seat in sequence from inside to outside; and the locating disk is mounted on the deep groove ball bearing.

3. The wheel rim finishing device according to claim 2, wherein a first supporting seat and a second supporting seat are also fixed on the stand; the supporting body is mounted in a guide hole of the second supporting seat; and the force application screw is in threaded connection with the first supporting seat and the weighing sensor.

4. The wheel rim finishing device according to claim 3, wherein an outer roller mounting seat is arranged between the supporting body and the outer roller; one end of the outer roller mounting seat is fixedly connected with the supporting body, and the other end of the outer roller mounting seat is connected with the outer roller through a locating pin.

5. The wheel rim finishing device according to claim 4, wherein the inner driving roller body is arranged in the shaft sleeve, and is connected with the motor through a key.

6. The wheel rim finishing device according to claim 5, wherein inner roller heads are arranged on the inner driving roller body and the inner driven roller body.

7. The wheel rim finishing device according to claim 6, wherein the inner roller heads are of tooth-form structures.

8. The wheel rim finishing device according to claim 7, wherein the outer surfaces of the inner roller heads and the outer roller follow the shape of the structure of a wheel rim.

* * * * *